US012234652B2

(12) United States Patent
Viviano

(10) Patent No.: US 12,234,652 B2
(45) Date of Patent: Feb. 25, 2025

(54) UNIVERSAL RAILING SYSTEM FOR LEVEL OR INCLINED APPLICATIONS

(71) Applicant: Robert P. Viviano, McKees Rocks, PA (US)

(72) Inventor: Robert P. Viviano, McKees Rocks, PA (US)

( * ) Notice: Subject to any disclaimer, the term of this patent is extended or adjusted under 35 U.S.C. 154(b) by 427 days.

(21) Appl. No.: 17/889,576

(22) Filed: Aug. 17, 2022

(65) Prior Publication Data

US 2024/0060308 A1 Feb. 22, 2024

(51) Int. Cl.
*E04F 11/18* (2006.01)

(52) U.S. Cl.
CPC ..... *E04F 11/1817* (2013.01); *E04F 11/1842* (2013.01); *E04F 2011/1827* (2013.01)

(58) Field of Classification Search
CPC ..... E04F 11/18; E04F 11/181; E04F 11/1817; E04F 11/1834; E04F 11/1842; E04F 2011/1819; E04F 2011/1921; E04F 2011/1923; E04F 2011/1825; E04F 2011/1827
See application file for complete search history.

(56) References Cited

U.S. PATENT DOCUMENTS

| | | | | |
|---|---|---|---|---|
| 1,757,686 | A * | 5/1930 | Rosenbaum | E04F 11/181 256/72 |
| 2,557,002 | A * | 6/1951 | Lathrop | E04F 11/181 256/65.12 |
| 2,563,530 | A * | 8/1951 | Hawkins | E04F 11/1834 403/186 |
| 2,909,361 | A * | 10/1959 | Dotson | E04F 11/1842 256/21 |
| 5,701,236 | A * | 12/1997 | Viviano | F21S 4/20 256/65.02 |
| 7,478,799 | B2 | 1/2009 | Viviano | |
| 2007/0221903 | A1* | 9/2007 | Robbins | E04H 17/1447 256/65.12 |

FOREIGN PATENT DOCUMENTS

| | | | | |
|---|---|---|---|---|
| DE | 2539901 | A1 * | 3/1977 | |
| DE | 2600057 | A1 * | 7/1977 | |
| FR | 2927381 | A1 * | 8/2009 | E04F 11/1817 |

* cited by examiner

*Primary Examiner* — Jonathan P Masinick
(74) *Attorney, Agent, or Firm* — carothers and carothers

(57) ABSTRACT

A universal railing system for level or inclined applications which includes spaced parallel upright rod balusters extending between top and bottom railings. The upper and lower ends of the rod balusters have bent rod terminal ends which are received through respective apertures of upper and lower channels which are secured respectively to the upper and lower rails whereby the baluster rod terminal ends may rotate within the channels in order to adapt the railing system from a level application to an inclined application.

7 Claims, 3 Drawing Sheets

UNIVERSAL RAILING SYSTEM FOR LEVEL OR INCLINED APPLICATIONS

BACKGROUND OF THE INVENTION

This invention relates to railing or hand railing systems, and more particularly, to railing systems which have minimal profile as to not inhibit a view being observed beyond the railing.

The present invention pertains to an improvement in the railing system invented by the present inventor and disclosed in U.S. Pat. No. 7,478,799, issued on Jan. 20, 2009. The subject patent discloses a railing system with thin low profile balusters so as not to block the scenic view beyond the railing. This is accomplished by providing spaced parallel upper and lower rails with spaced parallel upright balusters between the rails and wherein the upright balusters consist of rods. However, this prior art railing system requires different structural configurations for level applications and inclined applications, such as for stairs.

It is a principal object of the present invention to provide a universal railing system which not only provides the desired feature of not unduly blocking the view, but is additionally capable of being installed in either a level or inclined application without making modifications to the railing structure.

SUMMARY OF THE INVENTION

The universal railing system of the present invention for level or inclined applications is constructed of spaced parallel upper and lower rails, each with top and bottom sides and provided with spaced parallel upright balusters between the rails. The spaced parallel upright balusters each consist of a rod of predetermined diameter extending between the rails and each of the upright rod balusters is provided with upper and lower bent rod terminal ends which extend for a short predetermined distance in the general direction of extension of the rails.

Upper and lower elongate channels respectively extend with the upper and lower rails, each channel having an open side which is respectively secured against the bottom side of the upper rail and the top side of the lower rail, thereby providing an enclosed elongate channel passage in the channels. Spaced apertures are provided in the channels which receive the bent rod ends therethrough with the bent rod terminal ends received in the channel passages for retention in the channels. The diameter and thickness of the spaced apertures, the diameter and length of the bent rod terminal ends, and the depth of said channel passages are proportioned relative to each other whereby the bent rod terminal ends are permitted to pivot in the plane of the railing without falling out of the apertures.

These proportions can be specifically defined as indicated hereinafter. The diameter or the spaced apertures are dimensioned in relation to the diameter of the bent rod terminal ends to be at or in a ratio of 1.25 to 1 with a plus or minus tolerance of 15%. This permits the rod balusters to rotate in the vertical plane of the railing without the bent rod terminal ends falling out of their respective apertures.

In addition, the aperture diameters in relation to the thickness of these apertures is in or at a ratio of 1 to 5 with a plus or minus tolerance of 15%. Also the length of the terminal end of the bent rod ends in relation to the depth of the channel passage is set at a ratio of 1.714 to 1 with a plus or minus tolerance of 15%. These limitations further ensure proper operation of the railing system in different stages of inclination.

As will be explained in greater detail hereinafter, these ratios permit the rod balusters to rotate, but not to fall out of their respective apertures in which they are retained in order to thereby provide a universal railing system which may be applied to either a level or an inclined application.

An elastomeric damper liner preferably closes off the open sides of the channels in order to prevent the rod balusters from rattling, yet still permitting the rod balusters to rotate as required for an inclined application. The bent rod terminal ends are preferably bent to a hard right angle in order to thereby provide a hinged action between the bent rod baluster ends and their respective channel apertures.

BRIEF DESCRIPTION OF THE DRAWINGS

Other objects and advantages appear hereinafter in the following description and claims. The accompanying drawings show, for the purpose the exemplification, without limiting the scope of the invention or claims, certain practical embodiments of the present invention wherein:

DETAILED DESCRIPTION OF THE PREFERRED EMBODIMENTS

Figure 1:
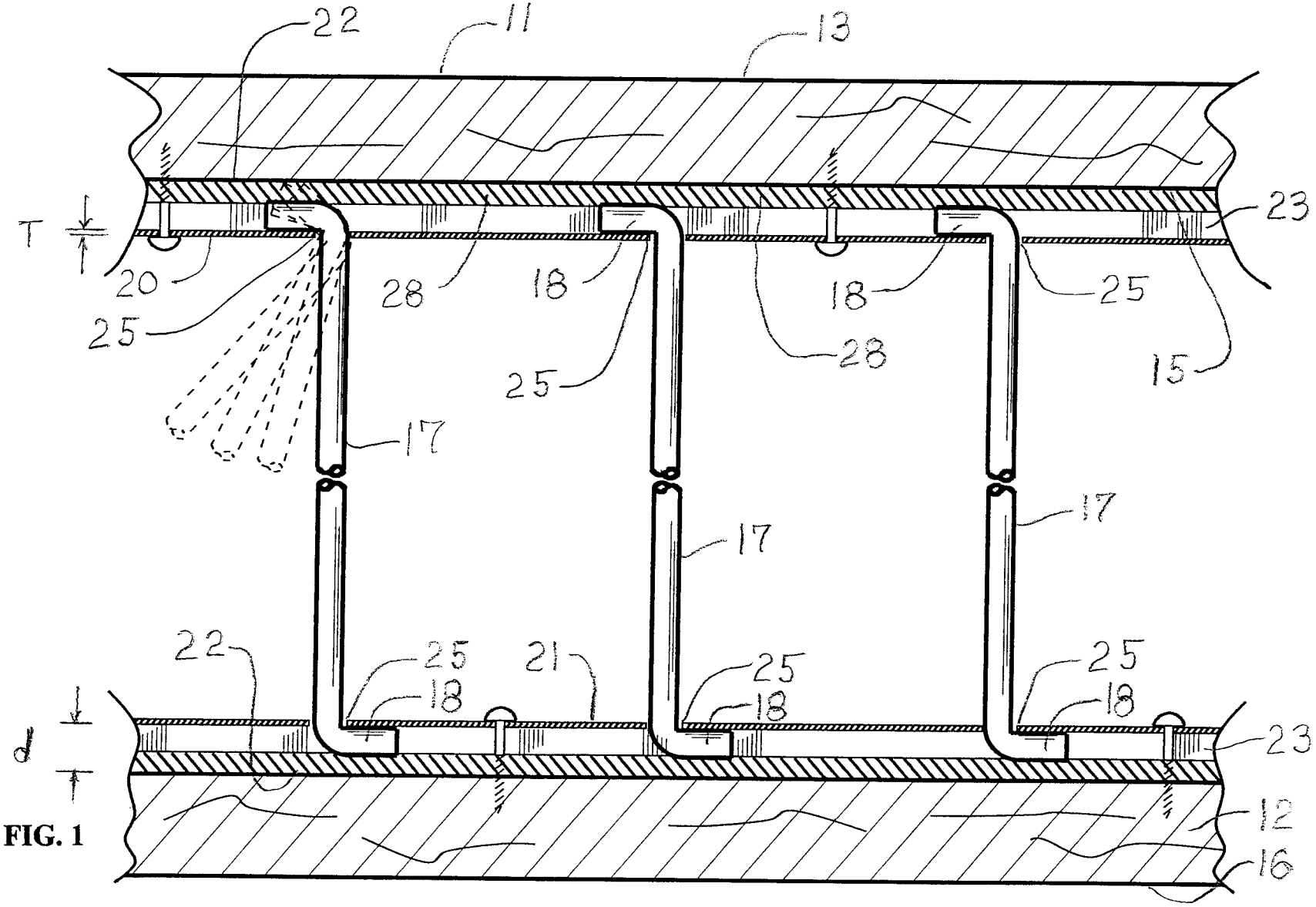
FIG. 1 is a view in front elevation of the universal railing system of the present invention with the spaced parallel upper and lower rails illustrated in mid vertical cross section.
Figure 2:
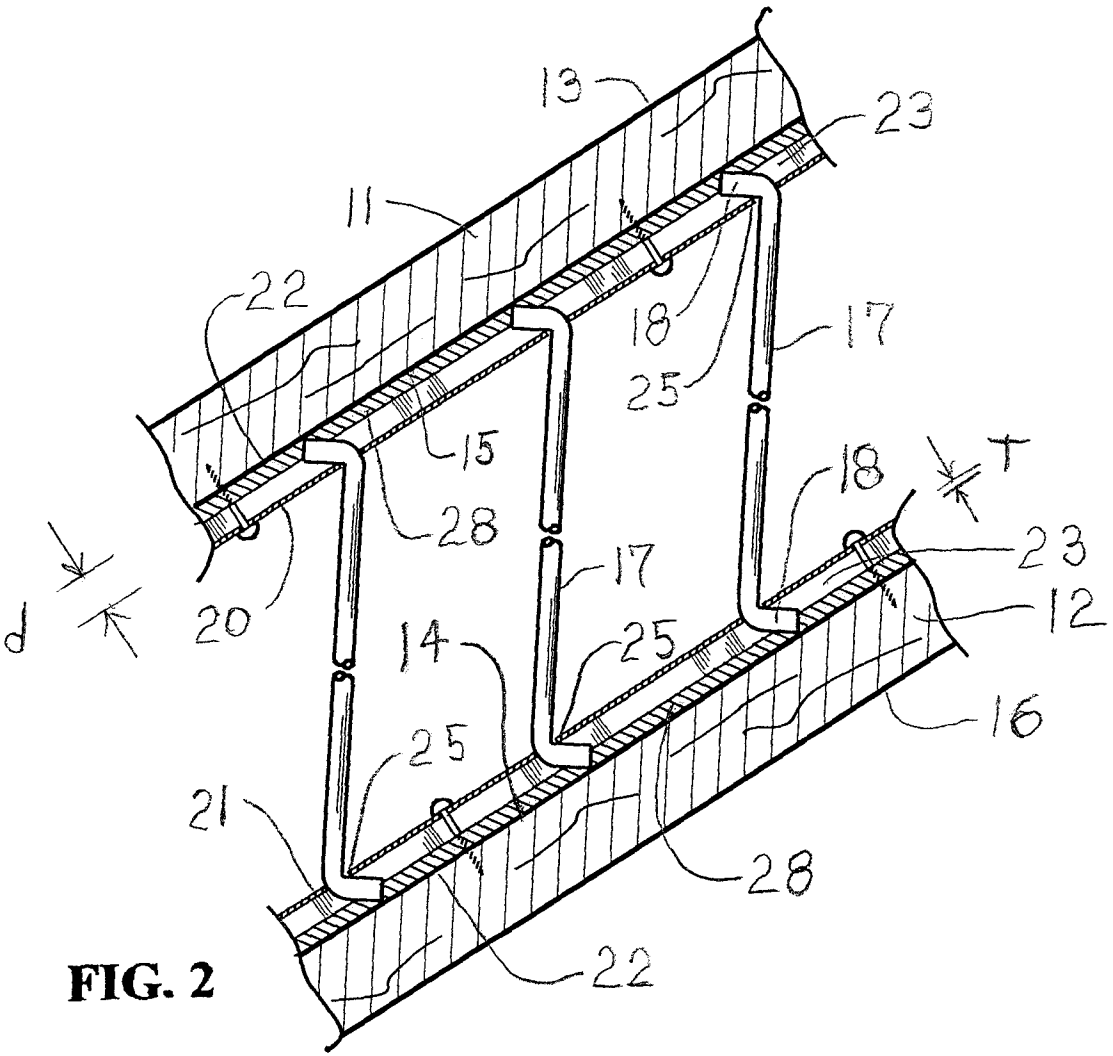
FIG. 2 is a view in front elevation of the universal railing system shown in FIG. 1, but adjusted for an inclined application.

Referring to the drawings, the universal railing system 10 may be selectively used for level applications as indicated in FIG. 1 or in inclined applications, such as for stairs, as illustrated in FIG. 2. Spaced parallel upper rail 11 and lower rail 12 each have top sides 13 and 14, and bottom sides 15 and 16 respectively, and are provided with spaced parallel upright balusters 17 between rails 11 and 12.

Spaced parallel upright balusters 17 each consist of a rod of predetermined diameter D having upper and lower bent rod terminal ends 18 which extend for a predetermined distance in the general direction of extension of their adjacent rails 11 and 12. The rod balusters 17 may be made of any suitable material, such as aluminum or stainless steel.

Upper and lower elongate channels 20 and 21 respectively extend with and are secured to the upper and lower rails 11 and 12 with screws as indicated. Each channel 20 and 22 is provided with an open side 22 which is respectively secured against the bottom side 15 of upper rail 11 and the top side 14 of lower rail 12, thereby providing an enclosed elongate channel passage 23 in said channels 20 and 21.

Spaced apertures 25 in channels 20 and 21 receive the bent rod terminal ends 18 therethrough with the bent rod terminal ends 18 received in the channel passages 23 for retention in the channels. The diameter of the spaced apertures 25 is dimensioned in relation to the diameter D of the bent rod terminal ends 18 at a ratio of 1.25 to 1 with a plus or minus tolerance of 15%. If this ratio is outside of the permitted tolerances, for example the apertures 25 are too large, this will permit the rod terminal ends 18 to fall out upon rotation, and if the apertures 25 are too small, the baluster rod terminal ends 18 cannot rotate as required in order to adapt from a level to an inclined application.

Figure 3:
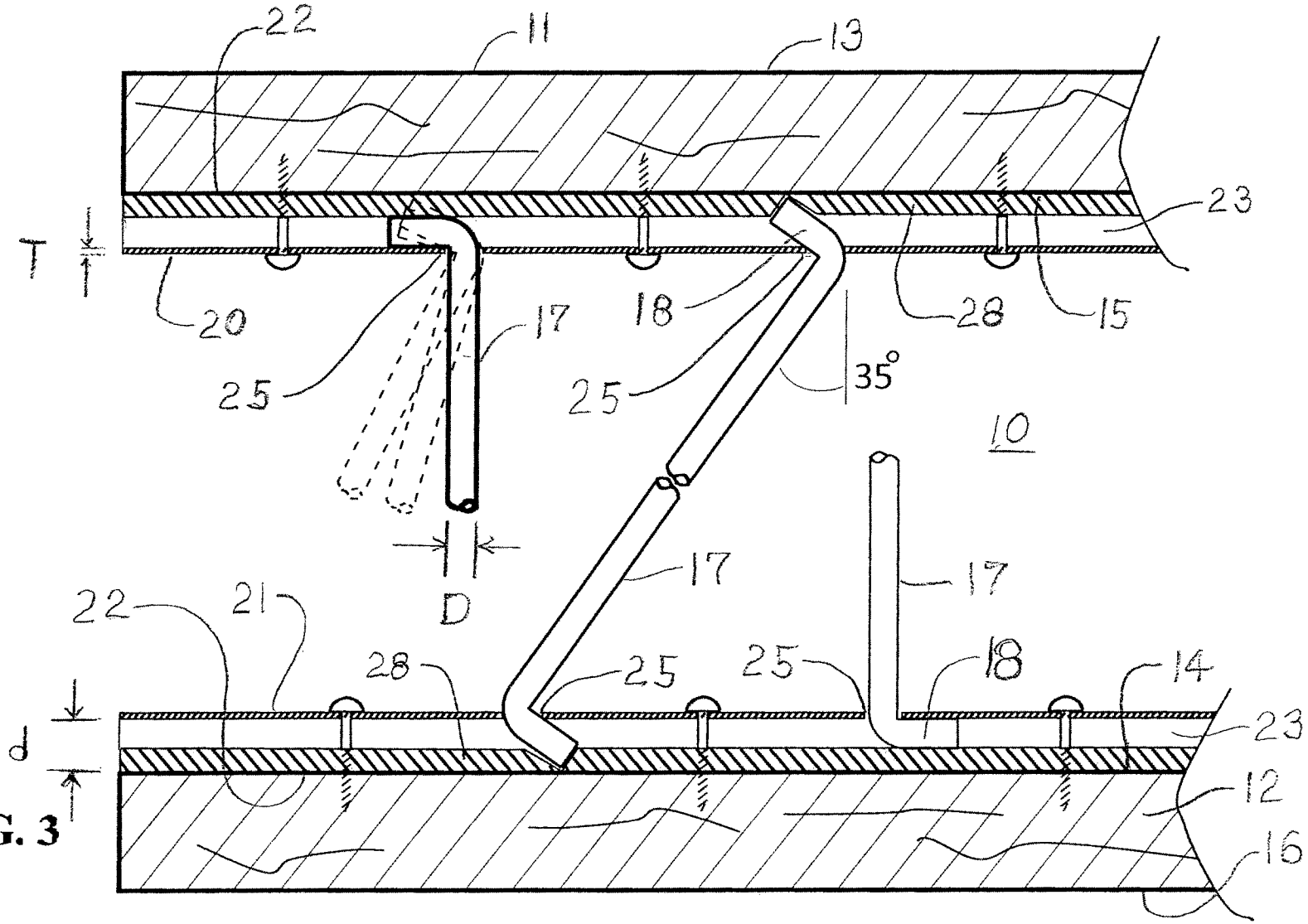
FIG. 3 is a view in front elevation of the universal railing system illustrated in FIGS. 1 and 2 with modifications disclosed therein to better illustrate the adaptability of the railing system from a level to an inclined application.

The diameter of apertures 25 in relation to the thickness T of the apertures are provided at a ratio of 1 to 5 with a plus or minus tolerance of 15%. As the thickness of apertures 25 increases, the apertures will need to accordingly increase in diameter. In addition, the rod diameter will need to be adjusted if the tolerances are exceeded as the baluster rod terminal ends 18 will fall out of the apertures 25 at one extreme and at the opposite extreme they cannot rotate within the apertures 25 as illustrated by the dashed outlines in FIG. 3.

The length of the terminal rod ends 18 in relation to the depth d of channel passages 23 is set at a ratio of 1.714 to 1 with a plus or minus tolerance of 15%. If these tolerances are exceeded, the rod terminal ends 18 will in one extreme not be able to hang on and will fall out of apertures 25, and in the other extreme will exceed the depths of channels 23 to such an extent that the rod balusters cannot be adequately rotated for inclined applications which generally require an angle of inclination of between 35 to 40°.

The universal railing system 10 further includes elastomeric damper liners 28 closing off the open sides 22 of channels 20 and 21. Elastomeric damper liners 28 prevent rod balusters 17 from rattling within their respective channels 20 and 21.

It will be noted that bent rod terminal ends 18 are bent to a hard right angle, as opposed to a curved or eased right angle. While slight differences in angle may be tolerated, nevertheless the hard bend of the angle is desired in order that the baluster rod terminal ends 18 can properly hinge within their respective apertures 25.

I claim:

1. A universal railing system for level or inclined applications comprising:

spaced parallel upper and lower rails, each with top and bottom sides and provided with spaced parallel upright balusters between said rails;

said spaced parallel upright balusters each consisting of a rod of predetermined diameter extending between the rails and each said upright rod baluster having upper and lower bent rod terminal ends which extend for a predetermined distance in the general direction of extension of said rails;

upper and lower elongate channels respectively extending with said upper and lower rails, each channel having an open side which is respectively secured against the bottom side of said upper rail and the top side of said lower rail, thereby providing an enclosed elongate channel passage in said channels;

spaced apertures in said channels receiving said bent rod ends therethrough with said bent rod terminal ends received in said channel passages for retention in said channels;

the diameter and thickness of said spaced apertures, the diameter and length of said bent rod terminal ends, and the depth of said channel passages are proportioned relative to each other whereby said bent rod terminal ends are permitted to pivot in the plane of said railing without falling out of said apertures.

2. A universal railing system for level or inclined applications comprising:

spaced parallel upper and lower rails, each with top and bottom sides and provided with spaced parallel upright balusters between said rails;

said spaced parallel upright balusters each consisting of a rod of predetermined diameter extending between the rails and each said upright rod baluster having upper and lower bent rod terminal ends which extend for a predetermined distance in the general direction of extension of said rails;

upper and lower elongate channels respectively extending with said upper and lower rails, each channel having an open side which is respectively secured against the bottom side of said upper rail and the top side of said lower rail, thereby providing an enclosed elongate channel passage in said channels;

spaced apertures in said channels receiving said bent rod ends therethrough with said bent rod terminal ends received in said channel passages for retention in said channels, the diameter of said spaced apertures dimensioned in relation to the diameter of said bent rod terminal ends at a ratio of 1.25 to 1 with a plus or minus tolerance of 15%.

3. The universal railing system of claim 2, wherein said aperture diameter in relation to the thickness of said apertures is at a ratio of 1 to 5 with a plus or minus tolerance of 15%.

4. The universal railing system of claim 2, wherein the length of the terminal end of said bent rod ends in relation to the depth of said channel passage is at a ratio of 1.714 to 1 with a plus or minus tolerance of 15%.

5. The universal railing system of claim 2, including an elastomeric damper liner closing off the open sides of said channels.

6. The universal railing system of claim 2, wherein said bent rod terminal ends at the top and bottom of each of said rod balusters extend in opposite directions.

7. The universal railing system of claim 2, wherein said bent rod terminal ends are bent to a hard right angle.

* * * * *